United States Patent [19]

Karazija

[11] 3,956,891

[45] May 18, 1976

[54] CLOSED CENTER HYDRAULIC SYSTEM FOR LIFT TRUCKS

[75] Inventor: Arvin Karazija, Oak Forest, Ill.

[73] Assignee: Allis-Chalmers Corporation, Milwaukee, Wis.

[22] Filed: Dec. 30, 1974

[21] Appl. No.: 537,610

[52] U.S. Cl. ..... 60/413; 60/414; 60/418; 60/484; 60/DIG. 2; 91/420

[51] Int. Cl.[2] ..... F15B 1/02; F15B 11/16

[58] Field of Search ..... 60/413, 414, 418, 484, 60/DIG. 2, 468; 91/420

[56] References Cited

UNITED STATES PATENTS

| | | | |
|---|---|---|---|
| 2,674,092 | 4/1954 | Gardiner | 60/418 |
| 2,841,960 | 7/1958 | Holan et al. | 91/468 X |
| 2,984,985 | 5/1961 | MacMillin | 60/471 X |
| 3,071,926 | 1/1963 | Olson et al. | 91/420 |

*Primary Examiner*—Edgar W. Geoghegan
*Attorney, Agent, or Firm*—Charles L. Schwab

[57] ABSTRACT

A closed center hydraulic system is provided for a lift truck which includes an accumulator, a motor driven pump for supplying fluid under pressure to the accumulator, a plurality of closed center proportional electrohydraulic control valves for a plurality of hydraulically operated devices on the truck such as the lift jack, the mast tilt jack and the hydraulic powered steering mechanism. The pressure to the steering control valve is reduced by a pressure reducing valve and the pressure fluid supply circuit from the accumulator to the lift and tilt circuits is controlled by a blocking valve which is opened when the manual control member for either the lift or tilt control valve is moved from neutral to an operating position. Initial movement of either manual control member causes the blocking valve to open and further movement meters flow, thus permitting the operator to regulate lift and tilt speeds. A return line interconnects the lift jack and reservoir in bypassing relation to the lift control valve and a pilot operated bypass valve in the return line has its pilot line connected to one of the lift control valve delivery ports. An energy recovery system is disclosed in the return line from the lift jack.

9 Claims, 1 Drawing Figure

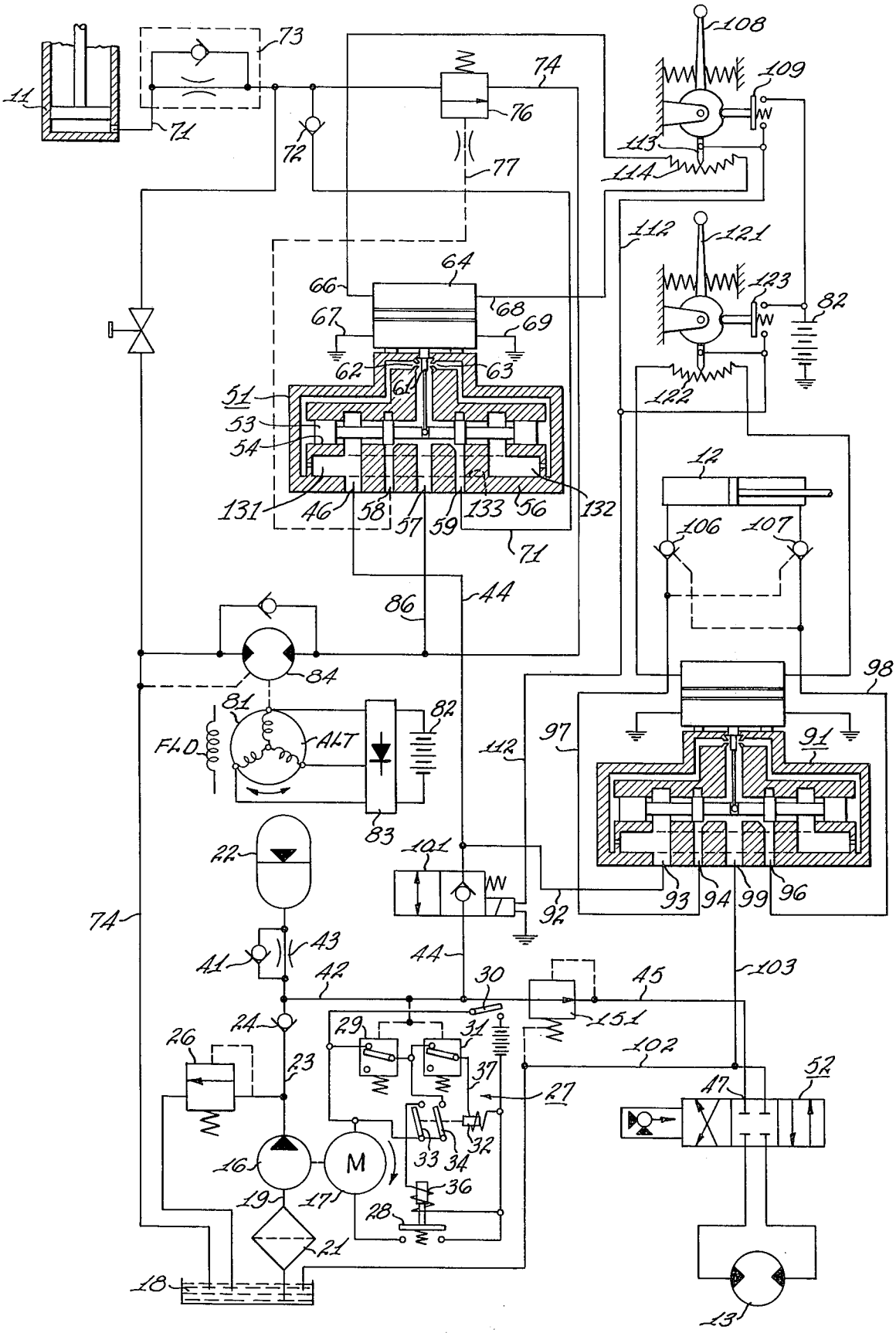
FLD
ALT
M

CLOSED CENTER HYDRAULIC SYSTEM FOR LIFT TRUCKS

BACKGROUND OF THE INVENTION

Heretofore electrically powered lift trucks have been provided with hydraulic systems in which pressure fluid is supplied by a motor driven pump whenever a hydraulic valve is shifted from its neutral position to an operating position, this being accomplished by motor control switches associated with the valve control mechanism. This results in frequent running of the pump motor and considerable energy is consumed in starting the motor and accelerating the pump to its operating speed. In the prior art systems the entire pump output is at relief pressure and often only a small fraction of the pump output is used to operate the particular function.

BRIEF DESCRIPTION OF THE INVENTION

A closed center hydraulic system includes an accumulator automatically maintained in a pressurized condition by a motor driven pump. A pump motor is started by a low pressure switch and stopped by a high pressure switch. The accumulator supplies the necessary pressure fluid to operate the various hydraulically operated control means on the truck and when the pressure in the accumulator drops to the pressure setting of the low pressure switch the switch will close to automatically energize the motor and build the pressure in the accumulator back to the pressure setting of the high pressure switch. Many times the operator will wish to steer, tilt the mast or raise or lower the load in small increments and these small movements will not usually discharge the accumulator to such an extent that the motor will need to run to recharge it. Thus, in the present invention, the frequency of starting and stopping the pump motor is considerably reduced over the prior art system wherein the pump was operated each time a hydraulic control valve was operated. Further, it has been found desirable in some types of lift trucks, such as order pickers, to use proportional electrohydraulic control valves which are pilot operated and are of a design having pilot fluid flow. In order to minimize the power loss due to the pilot fluid flow of these type valves, an electrically operated blocking valve is provided between the accumulator and at least some of these valves. Control means are provided to open the blocking valve whenever the downstream control valves are operated. Further, in order to minimize power losses, a reducing valve is provided in the steering circuit thus permitting the steering motor to be operated at a lower pressure.

BRIEF DESCRIPTION OF THE DRAWING

The drawing is a schematic showing of the present invention as used in a lift truck.

DETAILED DESCRIPTION OF THE DRAWINGS

Referring to the schematic drawing, the present invention is illustrated in a lift truck hydraulic control for operating hydraulic motors in the form of a lift jack 11, a double-acting tilt jack 12 and a steering motor 13. The source of fluid for the hydraulic control system includes a hydraulic pump 16 driven by an electric motor 17. The pump 16 draws fluid from a reservoir 18 by way of a line 19 in which a suitable filter 21 is disposed and delivers pressurized fluid to a gas-hydraulic accumulator 22 by way of line 23 in which the suitable check valve 24 is disposed to prevent return flow to the pump 16. A suitable pilot operated relief valve 26 is provided for the pump 16. The pressure in the accumulator 22 is regulated by pressure responsive motor control means 27 which includes the motor contactor 28 which is closed whenever low pressure switch 29 is closed and is opened whenever high pressure switch 31 is opened. As illustrated, a manual switch 30 is open thus deenergizing the pump motor control. When switch 30 is closed solenoid 32 is energized and closes switches 33, 34. The closing of switch 33 energizes the solenoid 36 of contactor 28 thereby causing it to close and start the pump motor 17. When the pressure in the accumulator rises to the value above the operating pressure for low pressure switch 29, the low pressure switch 29 will open. However, a holding circuit has been established through lead 37 and the high pressure switch 31 and, therefore, the switches 33, 34 remain closed until the predetermined operating pressure for high pressure switch 31 has been reached. Thus, the motor control means 27 automatically maintains the pressure in the accumulator 22 between predetermined maximum and minimum pressures. Fluid delivered to the accumulator flows with minimal restriction through check valve 41, but the fluid delivered by the accumulator to the fluid delivery line 42 passes through a restrictor 43 which regulates the rate of discharge of the accumulator. The fluid delivery line 42 branches into a pair of branch delivery lines 44, 45 which are connected to the pressure ports 46, 47 of closed center proportional electrohydraulic control vaves 51, 52. Control valve 51 has an axially shiftable flow control element in the form of a spool 53 disposed in a bore 54 of the valve housing 56. The pressure port 46 communicates with the bore 54 by way of pressure chambers 131, 132 which are interconnected by a passage 133. A reservoir port 57 and a pair of fluid delivery ports 58, 59 are also in communication with the bore 54. The control valve 51 is a MOOG Series 60 electrohydraulic servovalve marketed by Moog, Inc., Controls Division, Proner Airport, East Aurora, New York.

The spool 53 of control valve 51 is shifted to the right or left by the differential of the pressure acting on its axially opposite ends, such pressure differential being created by movement of a flapper 61 to the right or left into and out of flow obstructing relationship with orifices 62, 63. The flapper 61 is moved to the right or left by a pair of torque motor coils disposed within housing 64, the two coils being connected to electric leads 66, 67, 68, 69. A fluid delivery line 71 interconnects port 59 of the control valve 51 with the lift jack 11. A check valve 72 is disposed in line 71 to prevent return flow from the jack 11. A fluid regulating valve 73 is also provided to slow the discharge of fluid from the jack 11. Return flow from the lift jack 11 is achieved by provision of a return line 74 interconnected between the lift jack 11 and the reservoir 18. A pilot operated bypass valve 76 is operably disposed in the return line 74 and a pilot line 77 for operating the latter is connected thereto and to the delivery port 58 of control valve 51. As illustrated, the bypass valve is shown in its closed position; however, when the valve spool 53 is moved to the right, the latter will be placed in its lift jack lowering position and pressure fluid will be delivered through port 46, valve 51, port 58 and line 77 to actuate (open) the bypass valve 76.

In the illustrated embodiment of the invention, an energy recovery system is associated with the return line 74 which includes an alternator 81 operably associated with the lift truck battery 82 by way of suitable control means 83 and is connected in driven relation to a hydraulic motor 84 which is operably disposed in the return line 74. By using a bypass line 74, the energy losses through the control valve 51 are avoided when fluid is discharged from the lift jack 11, thus, a maximum amount of energy is made available to drive the hydraulic motor 84, which in turn drives the alternator to supply charging energy to the lift truck battery 82.

The illustrated energy recovery system is disclosed in greater detail in the copending U.S. patent application of Arvin Karazija and Michael H. Grace, Ser. No. 516,809, filed Oct. 21, 1974. Referring again to control valve 51, the pilot flow through the orifices 62, 63 is returned to the reservoir by a line 86 interconnecting reservoir port 57 and return line 74. A second closed center proportional electrohydraulic control valve 91 is provided for the tilt jack 12. The control valve 91 is identical to the previously described control valve 51 for the lift jack 11. A branch delivery line 92 is interconnected between the pressure port 93 of control valve 91 with the branch delivery line 44 downstream of a blocking valve 101 disposed in a branch delivery line 44. The delivery ports 94, 96 are connected to opposite ends of the tilt jack by fluid delivery lines 97, 98 and a reservoir port 99 is connected to the return-to-reservoir line 102 of the steering motor valve 52 by a return line 103. A pair of pilot operated locking valves 106, 107 are provided in the fluid delivery lines 97, 98. The blocking valve 101 is provided to prevent the energy loss associated with the pilot flow through the control valves 51, 91 when they are not being used to deliver fluid to or return fluid from the jacks 11, 12. This system makes efficient use of the available energy in the electric storge battery 82, which is particularly important to the users of electric powered lift trucks.

When it is desired to place the lift jack control valve 51 in its raise condition of adjustment, the operator will rotate the control lever 108 counterclockwise thereby closing a switch 109 to energize solenoid blocking valve 101 by way of lead 112. Counterclockwise movement of the lever 108 will cause unequal current flow from the battery 82 to the torque motor coils of the control valve 51 whereby the flapper 61 moves to the right. Movement of the flapper to the right retards flow through the orifice 63 thereby increasing pressure on the right end of valve spool 52 causing it to shift to the left to deliver pressure fluid from pressure port 46 to delivery port 59 by way of chamber 131, passage 133, chamber 132 and bore 54. By pivoting the lever 108 to move the wiper 113 along the rheostat 114 the axial position of the spool 53 can be accurately controlled to provide metered flow of fluid to the lift jack. Thus the operator is able to control the rate of lift. When the control lever is moved in a clockwise direction from its electrically balanced neutral position, in which it is illustrated in the drawing, the pilot operated bypass valve 76 will be actuated by delivery of pressure fluid to delivery port 58. Similarly, the tilt control valve 91 is operated by its pair of torque motors as controlled by manual control lever 121 and the associated rheostat 122. When the lever 121 is pivoted in either direction, switch 123 is closed to open the blocking valve 101. Both of the valves 51, 91 are constructed so that in the illustrated neutral position of their spools the delivery ports will be connected to the reservoir. This feature is desirable because of use of check valve 72 and pilot operated locking valves 106, 107 and insures positive load holding.

The hydraulic steering motor 13 does not require as high a pressure for its operation as do the lift and tilt jacks 11, 12. Accordingly, in order to minimize the pressure losses through the steering control valve 52, which is a Series 62 MOOG electrohydraulic servovalve, a pressure reducing valve 151 is used. The pressure reducing valve 151 is operative to automatically reduce the pressure of fluid delivered to the steering valve 52 to a predetermined value lower than the minimum pressure at which the motor control means 27 maintains the accumulator 22. The reduced operating pressure reduces the energy losses associated with the pilot flow through the steering control valve 52.

The embodiments of the invention in which an exclusive property or privilege is claimed are defined as follows:

1. A hydraulic control system for a lift truck having a reservoir, a source of pressure fluid, and a hydraulic lift jack, said system comprising:

a closed center control valve (51) having
- a flow control element (53) shiftable between neutral, raise and lower positions,
- a fluid receiving port (57) and
- a pair of fluid delivery ports (58, 59), a fluid supply line (44) interconnecting said source of pressure fluid and said fluid receiving port, a fluid delivery line (71) interconnecting one (59) of said delivery ports and said lift jack, a fluid return line (74) interconnecting said lift jack (11) and said reservoir (18) in bypassing relation to said control valve (51), a pilot operated bypass valve (76) interconnecting one (59) of said delivery ports and said lift jack, a pilot line (77) interconnecting the other (58) of said delivery ports and said bypass valve (76), said lift jack (11) being expanded when said flow control element (53) is shifted to said raise position and said pilot operated bypass valve (76) being adjusted from its closed condition to its open condition by pressure fluid in said pilot line (77) when said flow control element (53) is shifted to said lower position whereby fluid from said jack (11) flows to said reservoir (18) by way of said return line (74) without passing through said control valve (51).

2. The system of claim 1 and further comprising an energy recovery system including an electric generator driven by a hydraulic motor disposed in said return line.

3. In a closed center hydraulic system for an electrically powered lift truck of the type having a pressure fluid source including an accumulator, a reservoir, a pump, an electric motor driving said pump and pressure sensitive switch means automatically maintaining the fluid pressure between predetermined minimum and maximum values, the combination comprising:

a first hydraulic motor, a first closed center control valve connected in controlling relation to said first motor, a first supply line connecting said accumulator with said first control valve, a second hydraulic motor, a second closed center hydraulic valve connected in controlling relation to said second motor, a second supply line connecting said accumulator with said second control valve and a pressure reducing valve in said second supply line operative to reduce the pressure of fluid delivered to said second valve to a value below said minimum value.

4. The combination set forth in claim 3 wherein said first motor is a lift jack and said second motor is a steering motor.

5. A hydraulic control system for an electric lift truck comprising:

a source of electric energy, a fluid reservoir, an accumulator, a pump connected in fluid receiving relation to said reservoir and fluid delivery relation to said accumulator, an electric motor drivingly connected to said pump, electric control means operatively associated with said electric motor and operative to maintain the pressure in said accumulator between predetermined minimum and maximum values, a lift jack, a proportional electrohydraulic control valve having a flow control element shiftable from its neutral position to its raise position, a fluid delivery line interconnecting said accumulator and said control valve, a supply line interconnecting said control valve and said lift jack, a return-to-reservoir line interconnecting said control valve and said reservoir, an electrically actuated blocking valve operatively interposed in said delivery line and having open and closed positions, electric valve control means including valve control circuits between said source of electric energy and said control and blocking valves, respectively, and, switch means operatively associated with said circuits and having open and closed operating positions, said circuits being electrically energized in said closed position of said switch means thereby effecting movement of said flow control element of said control valve to its raise position and shifting of said blocking valve from its closed position to its open position.

6. The control system of claim 5 and further comprising a hydraulic steering motor, a fluid transmitting line interconnecting said accumulator and said steering motor and a pressure reducing valve operatively interposed in said fluid transmitting line operative to maintain the pressure of fluid delivered to said steering motor at a predetermined value below said minimum value.

7. The control system of claim 5 wherein said flow control element of said control valve has neutral, raise and lower positions and a pair of fluid delivery ports, one of which is connected to said supply line, and further comprising a return line interconnecting said lift jack and said reservoir, a pilot operated bypass valve in said return line having open and closed positions of adjustment and a pilot line interconnecting said bypass valve and the other of said fluid delivery ports.

8. The system of claim 7 wherein said source of electric energy is a battery and further comprising energy recovery means including an electric generator and a hydraulic motor in said return line drivingly connected to said generator.

9. The system of claim 7 and further comprising a hydraulic steering motor, a fluid transmitting line interconnecting said accumulator and said steering motor and a pressure reducing valve operatively interposed in said fluid transmitting line operative to maintain the pressure of fluid delivered to said steering motor at a value below said minimum value.

* * * * *